United States Patent [19]

Gunter et al.

[11] 4,135,275

[45] Jan. 23, 1979

[54] HIGH SPEED CARD

[75] Inventors: Josef K. Gunter; Thomas R. Jones; Phillip E. Dabbs, all of Durham, N.C.

[73] Assignee: Gunter & Cooke, Inc., Durham, N.C.

[21] Appl. No.: 809,618

[22] Filed: Jun. 24, 1977

Related U.S. Application Data

[63] Continuation-in-part of Ser. No. 727,233, Sep. 27, 1976, abandoned.

[51] Int. Cl.[2] ..... D01G 15/76

[52] U.S. Cl. ..... 19/107

[58] Field of Search ..... 19/107, 98, 105

[56] References Cited

U.S. PATENT DOCUMENTS

| | | | |
|---|---|---|---|
| 1,558,414 | 10/1925 | Thoma | 19/105 |
| 1,559,475 | 10/1925 | Thoma | 19/105 |
| 2,580,582 | 1/1952 | Nix | 19/105 |
| 2,788,547 | 4/1957 | Kaufman et al. | 19/98 X |
| 2,949,645 | 8/1960 | Noda | 19/107 X |
| 3,036,343 | 5/1962 | Strang | 19/98 X |
| 3,144,685 | 8/1964 | Aoki | 19/107 X |
| 3,145,425 | 8/1964 | Varga | 19/98 |
| 3,205,538 | 9/1965 | Miller et al. | 19/105 X |
| 3,304,582 | 2/1967 | O'Neal et al. | 19/107 |
| 3,308,511 | 3/1967 | Culpan | 19/98 X |
| 3,483,598 | 12/1969 | Bryan, Jr. | 19/98 X |
| 3,537,144 | 11/1970 | King, Jr. | 19/105 X |
| 3,707,020 | 12/1972 | Stewart | 19/107 |
| 3,737,952 | 6/1973 | O'Neal et al. | 19/107 |
| 3,849,837 | 11/1974 | Bass, Jr. et al. | 19/107 |

FOREIGN PATENT DOCUMENTS

| | | | |
|---|---|---|---|
| 1225082 | 9/1966 | Fed. Rep. of Germany | 19/105 |
| 1510314 | 11/1969 | Fed. Rep. of Germany | 19/107 |
| 1510473 | 11/1969 | Fed. Rep. of Germany | 19/105 |
| 2024590 | 7/1973 | Fed. Rep. of Germany | 19/107 |
| 832803 | 4/1960 | United Kingdom | 19/105 |
| 917615 | 2/1963 | United Kingdom | 19/105 |
| 960637 | 6/1964 | United Kingdom | 19/105 |
| 196581 | 6/1967 | U.S.S.R. | 19/98 |

*Primary Examiner*—Werner H. Schroeder
*Assistant Examiner*—Andrew M. Falik
*Attorney, Agent, or Firm*—David Rabin

[57] ABSTRACT

Significantly improved carding production capacity and materially lowered waste content in the resulting sliver is obtained by high-speed operation of the lickerin at a speed in the range of about 1400 to 2000 r.p.m. and related operation of the main cylinder at a speed such that the lickerin surface speed is in the order of 90% of the cylinder surface speed, with a stripper bar lickerin screen located specially below the lickerin.

3 Claims, 4 Drawing Figures

HIGH SPEED CARD

CROSS-REFERENCE TO RELATED APPLICATIONS

This is a continuation-in-part of copending application Ser. No. 727,233, filed Sept. 27, 1976, and now abandoned in favor of this application.

BACKGROUND OF THE INVENTION

In carding cotton fiber a good deal of both heavy and fine trash particles as well as undesirable short fiber and dust particles are characteristically present in the feed stock. The modern trend toward high-speed carding has substantially increased the difficulties encountered in cleaning the feed stock of such waste content in the course of carding, while the currently increasing use of open end spinning has made effective cleaning particularly important in preparing sliver for such spinning.

The present invention modifies conventional lickerin operating practice materially to improve waste cleaning results exceptionally during high-speed carding operation.

SUMMARY OF THE INVENTION

The improved carding results provided according to the present invention are obtained by increasing the lickerin operating speed so that it falls within the range of about 1400 to 2000 r.p.m. and operating the main cylinder in such relation that the lickerin surface speed is in the order of 90% of the cylinder surface speed, while employing the increased centrifugal force available at such lickerin speeds to remove any heavy trash particles from the feed stock below the lickerin and controlling the air currents generated by lickerin and cylinder operation at these points above the lickerin so that the stock being fed for carding is predominantly freed of undesirable short fiber together with any fine trash and dust particles present but so that usable fiber contained in the feed stock is predominantly retained on the lickerin and cylinder roll surfaces.

Heavy trash is removed below the lickerin by a stripper bar set with a nose thereof facing opposite the direction of lickerin rotation and positioned in the range of about 30° to 45° from the point of fiber release at the feed plate and with the stripper bar nose set at about 0.010 to 0.022 inch from the lickerin surface and tapering forwardly to a clearing of about 0.110 inch from the lickerin surface. Additionally, a lickerin screen is mounted below the lickerin with a nose facing in the same direction and positioned at about 90° from the point of fiber release at the feed plate and set at about 0.010 inch from the lickerin surface to remove somewhat lighter trash that may pass the stripper bar. The air currents about the lickerin are controlled by means such as is disclosed in U.S. Pat. No. 3,737,952.

Carding operation according to the present invention can be conducted equally well with either cotton or synthetic fiber feed stock. Successful representative operation with cotton feed stock has been conducted with a 50 inches main cylinder running at 306 r.p.m. in relation to a 9 inches lickerin operated at 1570 r.p.m. with a resulting lickerin surface speed corresponding to 9.24% of the cylinder surface speed. Production under these conditions was at the rate of 120 lbs./hr. with waste removal at approximately 4% and a sliver fiber array of average mean length equal to, or in excess of, the average means fiber length in the feed stock, while maintaining an operating efficiency of 95% or better and producing sliver of excellent evenness and containing waste at a level of about 0.6%.

The carding operating arrangement employed is as described in further detail below in connection with the accompanying drawings that correspond to the following description.

DETAILED DESCRIPTION OF THE INVENTION

Figure 1:
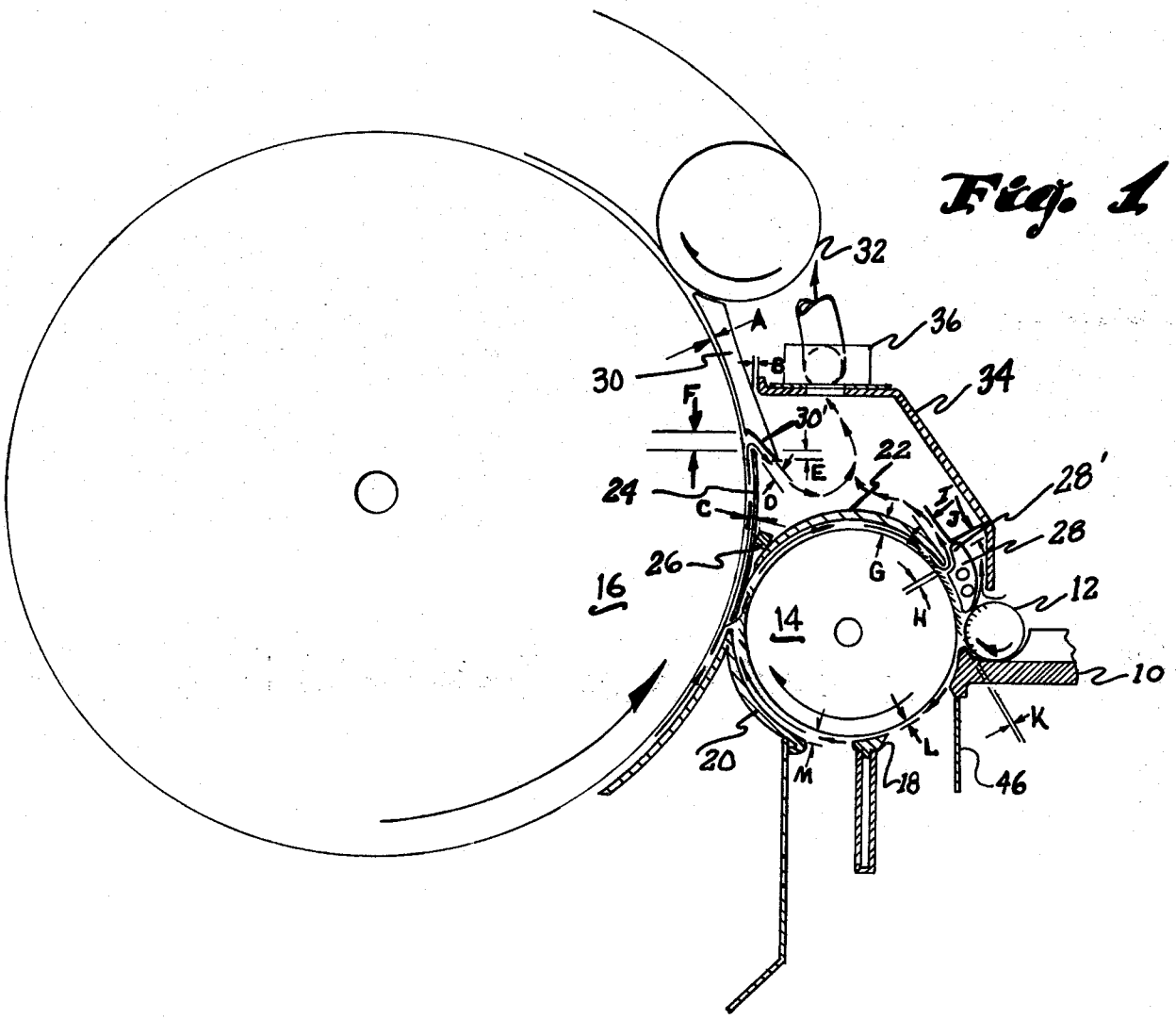
FIG. 1 is a more or less diagrammatic side elevation indicating the lickerin and main cylinder arrangement employed according to the present invention.

FIG. 1 indicates the card feed plate at 10 over the front nose of which feed stock is delivered by the action of a feed roll 12 thereat to present the leading edge or fringe of the feed stock to the lickerin 14 for combing fiber therefrom and transferring it to the main cylinder 16 at which the lickerin 14 runs tangent. Beneath lickerin 14 a stripper bar 18 is arranged as shown in spaced advance of a lickerin screen structure 20. At the high lickerin operating speed employed both the stripper bar 18 and the screen 20, particularly the noses thereof, act successively by reason of the corresponding high centrifugal force available to remove heavy trash particles from the feed stock with great effectiveness.

Beyond the tangency point at main cylinder 16 respective lickerin and cylinder cover plates 22 and 24 are installed in diverging relation with an air strip 26 lodged between their adjacent portions to block escape of air thereat so that the air currents generated by the high speed lickerin and cylinder operation are initially confined beneath these cover plates 22 and 24 to travel at the lickerin and cylinder surfaces and act to seat fiber carried at these surfaces in the clothing thereat.

A rear baffle member 28 is additionally disposed in lickerin covering relation at a spacing from the rear edge of cover plate 22 ahead of feed roll 12 and is formed with a nose portion 28 extending to overlap this rear edge also at a spacing. A front baffle member 30 is similarly disposed at cylinder 16 at a spacing beyond the top edge of cover plate 24 ahead of the card flats, indicated in FIG. 1 at 32, and is likewise formed with a spaced overlapping nose portion 30'. Above lickerin 14 a hood structure 34 is arranged with a suction fitting at 36 so that extraction air currents are induced within hood structure 34 as indicated by the arrows in FIG. 1. This arrangement functions in the manner disclosed and claimed in U.S. Pat. No. 3,737,952 to relieve this lickerin and cylinder air currents against "blow out" tendencies while reversing the direction in which the relief takes place so that objectionable short fiber together with small trash and dust particles are entrained and removed to an exceptionally advantageous extend from the seated fiber going forward on the lickerin and cylinder surfaces.

Figures 2, 3:
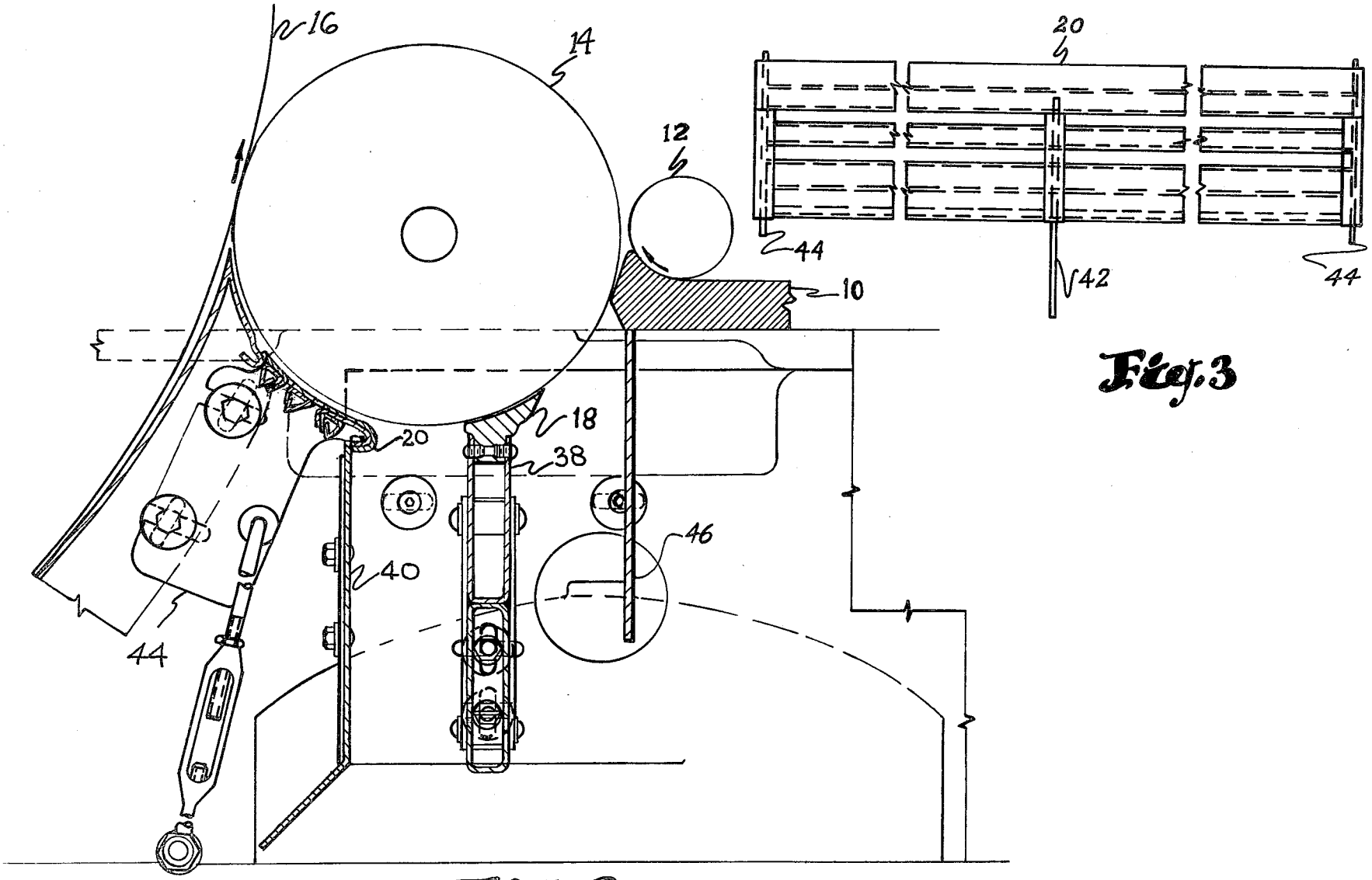
FIG. 2 is an enlarged generally corresponding side elevation showing the lickerin undercasing arrangement more in detail.
FIG. 3 is a plan detail of the lickerin screen.

FIGS. 2 and 3 show the lickerin undercasing arrangement in greater detail. As shown, the stripper bar 18 is supported by an adjustable bracket structure 38 spaced vertically rearward of a front baffle 40 that reaches upwardly behind the nose portion of lickerin screen structure 20. The screen 20 is of the bar type and is suitably fitted with a center brace 42 and end support pieces 44 arranged for adjustable mounting. Additionally, a rear baffle 46 is arranged vertically below the nose of feed plate 10.

Representative settings at the points indicated in FIG. 1 to provide the improved cleaning advantage obtainable according to the present invention are as follows:

| Setting | Dimension In Inches | Elements Involved |
|---|---|---|
| A | .022 | Front baffle to wire |
| B | 0-.250 | Hood to front baffle |
| C | .107 | Cylinder cover plate to wire |
| D | .625 | Front baffle overlap space |
| E | .250 | Front baffle overlap extent |
| F | 1.00 | Front baffle slot spacing |
| G | .125 | Lickerin cover plate to wire |
| H | .125 | Rear baffle slot spacing |
| I | .218 | Rear baffle overlap extent |
| J | .437 | Rear baffle overlap extent |
| K | .017 | Rear baffle to wire |
| L | .010-.022 | Stripper bar nose to wire |
| M | .010-.125 | Screen nose to wire |

Figure 4:
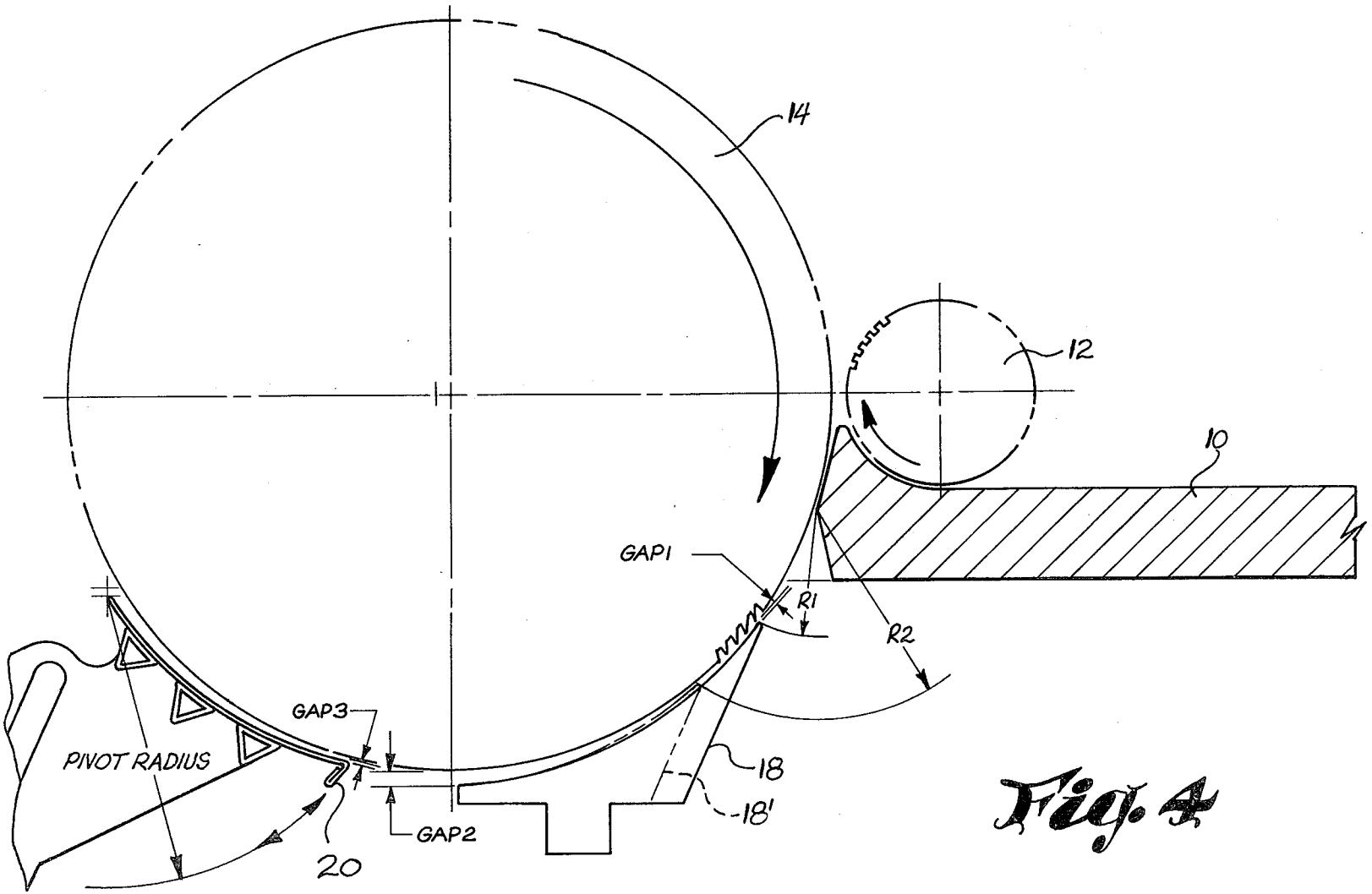
FIG. 4 is an enlarged fragmentary side elevation of the lickerin and related elements.

FIG. 4 shows the lickerin 14 and related elements on an enlarged scale. The feed roll is shown at 12 and the feed plate at 10, while the stripper bar 18 is indicated as being available in various widths as represented in the range between 18 and 18', which may subtend an arc of the lickerin not to exceed 90° with the respective noses thereof positioned in the range from about 30° (R1) to 45° (R2) from the point of fiber release at the feed plate 10, while the Gap 1 setting corresponds to L (i.e., about 0.010 to 0.022) in the foregoing table and Gap 2 setting being about 0.110 as aforesaid. The lickerin screen nose setting (Gap 3) corresponds to M (i.e., about 0.010 to 0.125) in the foregoing table and is positioned at about 90° from the point of fiber release at the feed plate 10, so as to remove somewhat lighter trash which takes longer to leave the lickerin 14 centrifugally.

The present invention has been described in detail above for purposes of illustration only and is not intended to be limited by this description or otherwise to exclude any variation or equivalent arrangement that would be apparent from or reasonably suggested by the foregoing disclosure to the skill of the art.

We claim:

1. Carding apparatus for fiber feed stock comprising; a feed roll and feed plate for said stock, a lickerin thereat operated at a speed in the range of 1400 to 2000 r.p.m. and a related cylinder operated at a speed such that the lickerin surface speed is in the order of 90% of the cylinder surface speed, a stripper bar set below the lickerin having a nose and a trailing end, said nose being positioned in the range of about 30° to 45° from the point of fiber release of the feed plate, said stripper bar having a concave fiber support surface in juxtaposition with and extending incrementally away from said lickerin from said nose to said trailing end, a lickerin screen additionally set below said lickerin having a nose positioned at about 90° from the point of fiber release at the feed plate whereby the centrifugal force available at such lickerin speeds acts to remove trash particles from the feed stock and the stock being fed for carding is predominantly freed of undesirable trash particles present but so that unusable fiber contained in the feed stock is predominantly retained on the lickerin and cylinder surfaces.

2. Carding apparatus for feed stock as claimed in claim 5, wherein said noses of said lickerin screen and said stripper bar are positioned less than half the distance from said lickerin surface than is the trailing end of said rearwardly extending fiber support surface.

3. Carding apparatus for feed stock as claimed in claim 1, said stripper bar nose and trailing end being spaced apart to subtend an arc of said lickerin of not more than 90° thereof.

* * * * *

UNITED STATES PATENT OFFICE

CERTIFICATE OF CORRECTION

Patent No. 4,135,275 Dated January 23, 1979

Inventor(s) Josef K. Gunter et al.

It is certified that error appears in the above-identified patent and that said Letters Patent are hereby corrected as shown below:

Claim 2, line 2, "5" should read -- 1 --.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*